United States Patent [19]

Creamer

[11] 4,025,671

[45] May 24, 1977

[54] METHOD FOR APPLYING CONTINUOUS LONGITUDINAL BANDS OF LIQUID COATING TO A MOVING STRIP

[75] Inventor: Robert M. Creamer, Richmond, Va.

[73] Assignee: Philip Morris Incorporated, New York, N.Y.

[22] Filed: Jan. 22, 1975

[21] Appl. No.: 543,126

Related U.S. Application Data

[62] Division of Ser. No. 323,302, Jan. 12, 1973, abandoned.

[52] U.S. Cl. ..... 427/286; 427/210; 427/434 A; 118/221; 118/225; 118/411; 118/412

[51] Int. Cl.[2] ..... B05D 5/00; B05D 1/18

[58] Field of Search ..... 118/410, 411, 412, 221, 118/225; 427/286, 434, 434 A

[56] References Cited

UNITED STATES PATENTS

| | | | |
|---|---|---|---|
| 558,542 | 4/1896 | Wheeler | 118/412 |
| 1,454,363 | 5/1923 | Winchenbaugh et al. | 118/412 X |
| 3,278,960 | 10/1966 | Nardone | 427/286 X |
| 3,393,661 | 7/1968 | Sharp | 118/411 |
| 3,413,143 | 11/1968 | Cameron et al. | 118/411 X |
| 3,421,926 | 1/1969 | Davies et al. | 427/177 |
| 3,422,796 | 1/1969 | Baber | 118/411 |
| 3,496,012 | 2/1970 | Biorseth | 118/410 X |
| 3,556,832 | 1/1971 | Park | 427/173 |

*Primary Examiner*—Ronald H. Smith
*Assistant Examiner*—Evan K. Lawrence
*Attorney, Agent, or Firm*—Watson Leavenworth Kelton & Taggart

[57] ABSTRACT

Method for coating a continuous moving strip of material with a liquid coating material such as a plastic or polymer material is disclosed and in which the moving strip to be coated is directed in contacting engagement with a curved peripheral surface on a fixed coating head disposed transverse to the direction of strip travel, with the coating material being supplied through a central passage in the coating head and outletting through a radial passage formed in one or more lands in the coating head, which lands are girded on opposite sides by grooves. The coating head is fixed such that the outlets in the lands desirably are located adjacent the point of last contact of the moving strip with the coating head so that a meniscus of material is established at said location and is in contact with both the land surface and strip to permit pickup of the coating material by the strip.

2 Claims, 9 Drawing Figures

METHOD FOR APPLYING CONTINUOUS LONGITUDINAL BANDS OF LIQUID COATING TO A MOVING STRIP

CROSS REFERENCE TO RELATED APPLICATIONS

This is a division, of application Ser. No. 323,302, filed Jan. 12, 1973, now abandoned.

BACKGROUND OF THE INVENTION

For certain purposes it is necessary to place on a continuous strip of web material, such as paper, one or more bands of a liquid coating material in thin layers running lengthwise of the strip and spaced laterally across the strip. The coating material may be, e.g., a plastic or polymer material in a melt form, but is more usually provided in solution or dispersion in water or other fairly volatile solvent.

In the past it has been customary to print such material on the web, as by employing a rotating roller or multiple rollers. These rollers can be ridged or grooved to produce the separate bands. However, the bands produced in this way are often somewhat non-uniform, both as to thickness of material application and as to straightness of the edges. Further, only certain limited viscosities of coating material solution or melt have been usable. A too-thin composition, for example, tends to be spattered by the rotating roll. Cylindrical coating heads demand a high viscosity solution (e.g. 5000 cp) if the application is to be limited to discrete bands; lower viscosities will permit the solution to flood the entire cylinder.

Accordingly, it is desirable that there be provided apparatus and method with which a moving web of material such as paper can be coated in a manner overcoming the problems and limitations described aforesaid.

SUMMARY OF THE PRESENT INVENTION

The present invention provides method and apparatus with which a continuous moving strip of material, as for example, a strip of paper can be coated on one or both faces thereof with one or more continuous bands or coatings of a suitable material such as a polymer material. It is useful for applying coating materials having viscosities from about 1 cp to more than $10^4$ cp, such material being provided in any suitable liquidous form such as a hot melt or as a solution of the material. In accordance with the present invention, a coating head is disposed across the direction of travel of the strip. Thus a head having a generally elongated, e.g., cylindrical form and mounted in fixed position with its long axis extending transversely of the direction of travel of the moving strip, is provided with a number of circumferentially directed grooves and lands in its outer peripheral surface. The lands preferably have a width that will yield the desired band coating to be made on the moving strip. The moving web of material is directed in a lead-in contacting engagement with the outer surface of the coating head and a supply of the coating material is fed through the coating head through an internal passage therein which has branch passages extending radially therefrom to outlet in openings at the surface of each land so that in this manner the coating material is conveyed to the exterior of the coating head with such openings preferably being located adjacent to but downstream of the point of last contact or lead-off contact of the moving strip with the coating head. The latter arrangement thereby provides the formation of a meniscus of coating material at the surface of each land which is in contact with both the strip and the land surface providing a stock of material which is picked up by the moving strip as it leaves the coating head, the pickup being effected in the form of a continuous band coating of the precise predetermined dimension which is related to the width of the land and other variables, and with the separation between adjacent bands being produced by the sharp break-off of the meniscus at the groove surfaces which are adjacent the lands. Desirably the contact of the moving strip with the coating head is limited to an arc of 180° or less on a generally cylindrical head as measured with respect to the long axis of the coating head although by using idler rolls in support of the moving strip contacts in arcs up to 340° are possible. In this manner it is unnecesary to provide a completely curved face surface on the coating head it being required only that the latter have a curved, e.g., convex surface where the contact of the moving strip is made therewith. Desirably the lands and grooves are made substantially uniform in respect of their dimension, that is, the widths of the lands and grooves adjacent therewith are substantially uniform from start to finish of the course of the groove and/or land. Preferably the curved surface of the coating head which is contacted by the moving strip need only be convex in shape although it can be provided in the form of an arc of a circle, that of an elipse etc. The only essential requirement is that it provide a smooth path of travel for the moving strip while in contact therewith.

The grooves and lands in the coating head preferably are formed to extend parallel with each other and transverse of the long axis of the head.

Preferably, the branch passages used to convey the coating material to the surface of the lands outlet at openings in such lands which are disposed substantially symmetrically about a cutting plane bisecting the land. In this manner there occurs delivery of the coating material at an optimum centralized location on the lands so that the pickup of same in uniform manner is effected to produce a substantially uniform coating on the moving strip.

The invention further provides that the coating head be mounted such that it can be rotatably adjusted with respct to its long axis to thereby alter the location or positioning of any branch passage outlets relative to the contact course of the strip with the head.

The invention accordingly comprises the features of construction, combination of elements and arrangements of parts which will be exemplified and construction hereinafter set forth and the scope of the invention will be indicated in the claims.

BRIEF DESCRIPTION OF THE DRAWINGS

A fuller understanding of the nature and objects of the present invention will be had from the following detailed description taken in conjunction wth the accompanying drawings in which.

Throughout the description like reference numerals are used to depict like parts in the drawings.

DESCRIPTION OF THE PREFERRED EMBODIMENTS

As used herein "coating" is intended to mean a plastic or polymer material, or other solid or liquid material, which is to be applied to a moving strip. The material can be a thermoplastic of any type although most usually it will be a polymer material. It is also possible to apply solutions or dispersions, aqueous or otherwise of solids other than polymers, such as for example sodium silicate, flavors, burn control agents, colorants or the like. It can be provided in various forms for coating purposes, such as in hot melt form or in solution or dispersion with a suitable vehicle. As used herein "strip" is intended to mean a continuous strip of any material which is to be coated with the coating material, for example, a continuous strip of paper, thermoplastic, foil or metal, or such other like form of material.

Figure 1:
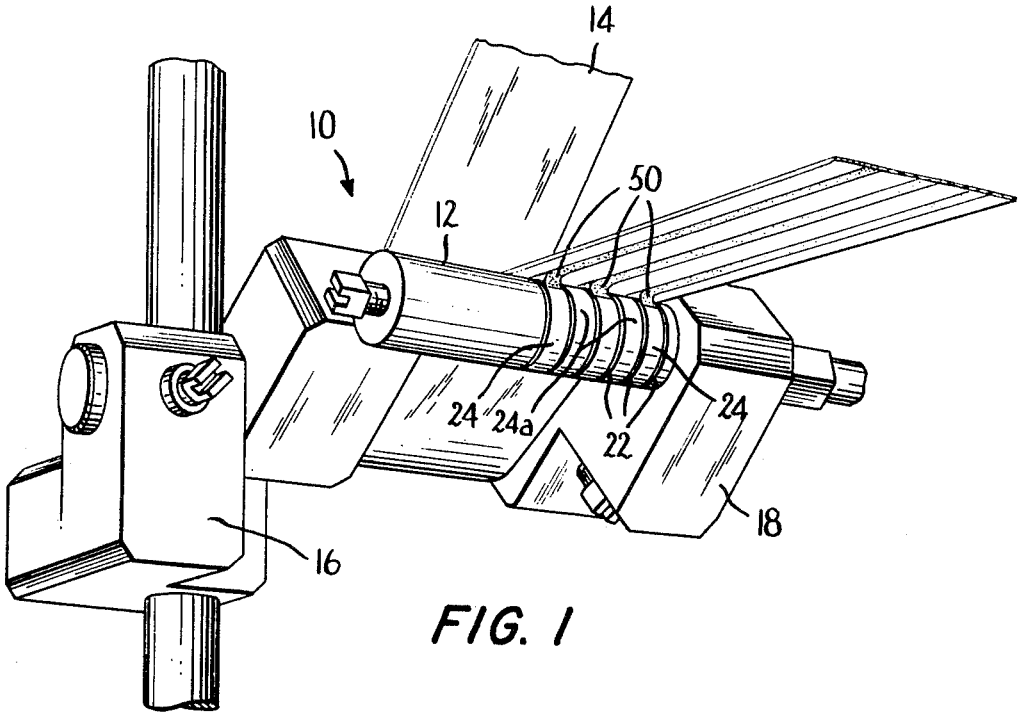
FIG. 1 is a perspective view of a coating device of the present invention showing the manner in which the coating head is mounted in fixed position in respect of the travel of the moving strip, there being depicted further the application of plural band coatings of a coating material to one face of the moving strip.

Referring now to FIG. 1, there is depicted apparatus 10 which includes a coating head 12 mounted in fixed position and extending across the strip course travel, e.g., with its long axis extending generally transverse to the direction of movement of strip 14, such mounting being provided by suitable mounting blocks 16 and 18 with the coating head being rotatably supported in the mounting blocks 16, 18 and having further an adjustment blocking nut 20 which can be loosened to permit rotation of the coating head about its own longitudinal axis for the purposes that will be made apparent later on. As can be seen in FIG. 1 the strip 14 to be coated, for example, a moving strip of paper to be coated in the depicted embodiment on one side, can be advanced in contacting engagement with the coating head through a course which involves lead-in from the bottom, contact with the coating head and then lead-off in a travel to the right such contact, for example, involving engagement through a course of 180° or less on the coating head as measured in respect of the axis of the coating head.

Figure 2:
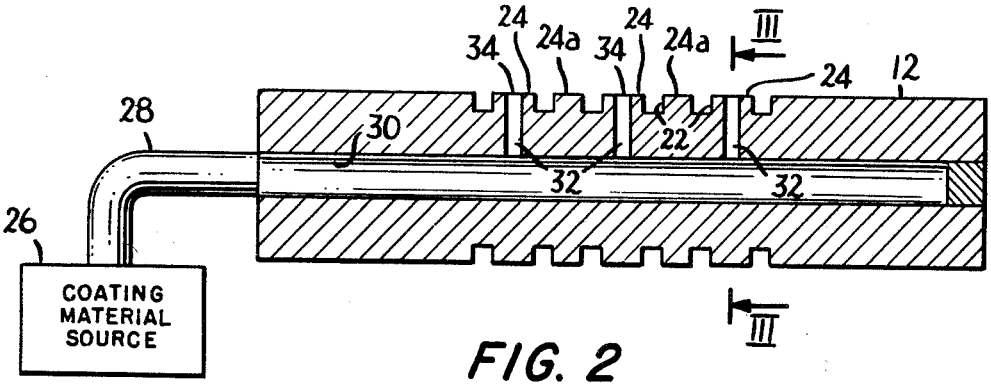
FIG. 2 is a longitudinal vertical sectional view of the coating head shown in FIG. 1.
Figure 3:
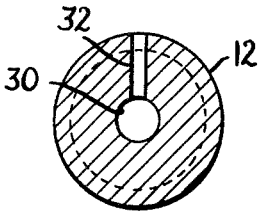
FIG. 3 is a transverse sectional view of the coating head as taken along the line III—III of FIG. 2.

The coating head 12 as can be best noted in FIGS. 1 and 2 is provided with a number of grooves 22 which extend inwardly of the surface of the coating head and each two of which define therebetween a land 24 in the surface of the coating head. The land 24 desirably has the required lateral dimension to yield the desired width of the coating material bands to be applied to the moving strip. The present invention provides that the surface of the coating head which is contacted by the moving strip desirably be a curved or rounded surface, i.e., generally a convex surface. Such surface can be provided as a fully encircling surface in the instance of an elongated cylindrical coating head or it can be arcuate through only a portion of the encircling periphery of the coating head so long as such rounded or curved surface be that with which the moving strip makes contact. The apparatus also includes a source 26 of the material to be coated on to the strip which is delivered through a suitable delivery conduit 28 to a central passage 30 formed in the coating head. The central passage 30 preferably extends axially of the coating head and is provided further with radially directed branch passages 32 extending outwardly from the internal passage 30 to termination in openings 34 in the surfaces of at least certain of the lands 24 formed in the external surface of the coating head.

In use the strip 14 is advanced in contacting engagement with the coating head 10 and particularly with the lands 24 thereon. The coating head is arranged so that the openings 34 in the lands 24 are located adjacent to but down-stream of the last point of contact of the moving strip with the coating head. In this manner the outflowing coating material establishes a meniscus 50 (FIG. 4) which is in contact with both the land surface and with the near face surface of the moving strip, the moving strip picking up a uniformly applied coating of material in bands in correspondence to the arrangement of lands which are in communication with the central passage 30. As can be seen in FIGS. 1 and 2, certain lands **24*a* are not used for coating purposes but instead are used as supports to prevent flexure or buckling of the strip to thereby insure optimum uniform application of the coating material in the intended band pattern. The presence of the grooves 22 adjacent the lands 24 which are used for coating purposes serve to break sharply the meniscus expanse 50** to prevent any feathery edged coating patterns in the applied bands as well as to sharply mark the maximum lateral dimension in which coating is effected.

Preferably the branch passages 32 are located centrally in respect of the associated land 24, that is to say the passages outlet at openings 34 which are disposed symmetrically about a cutting plane bisecting the land. The respective lands 24 and grooves 22 are formed in the coating head to extend transversely in respect of the long axis of the coating head and parallel with each other.

As shown in FIG. 1 the moving strip advances from the underside of the coating head in contacting engagement with the latter and traverses the course about the convex surface of the same to a point at which lead-off occurs, such contact in the depicted embodiment being 180° or less in respect of the total circumference of the coating head. The openings 34 in the lands 24 desirably are located adjacent to but downstream of the last point of contact of the moving strip with the coating head, most preferably about 5° beyond such point of last contact. If it is desired to further alter the positioning of the openings in respect of the last point contact of the strip this can be effected by loosening the nut 20 and rotating the coating head device 10 about its own axis to the desired location.

Figure 4:
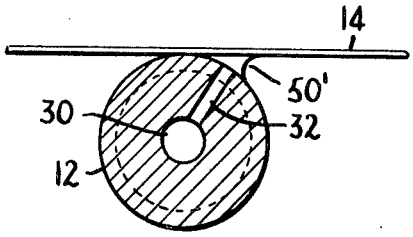
FIG. 4 is a schematic depiction in elevation of the manner in which the coating head shown in FIGS. 1–3 is used to apply coating material to the moving strip.

FIG. 4 depicts a modification in the manner in which the moving strip 14 is advanced into contact with the coating head. In such instance, the contact of the moving strip 14 with the coating head 12 is in tangential point contact only with the meniscus 50' associated with the coating application being located adjacent the point of contact as is shown.

Figure 6:
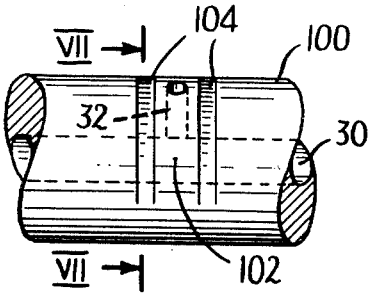
FIG. 6 is a fragmentary elevational view depicting a modified form of device in which the grooves and lands extend only partly around the circumferential periphery of the coating head.
Figure 7:
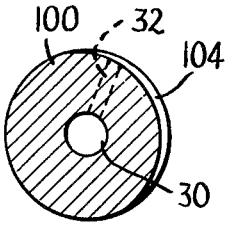
FIG. 7 is a vertical sectional view as taken along the line VII—VII in FIG. 6.
Figure 8:
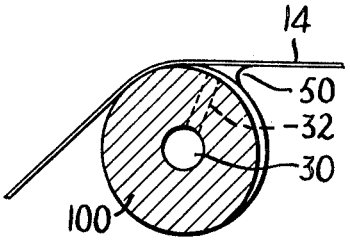
FIG. 8 is a schematic depiction in section of the manner in which the coating head shown in FIGS. 6 and 7 is used to apply coating material to a moving strip, the traveling course of the moving strip being shown as being in contact with the coating head through a limited arc only.

It is not necessary that contact of the moving strip with the coating head be through any appreciable course around the periphery of the coating head and further that the lands with which the coating is effected also extend in fully encircling course on the coating head. Thus, as shown in FIGS. 6–8, the coating head 100 may include a land 102 which extends around only a portion of the outer periphery of the coating head 100, the convex periphery provided by the land extending in this instance only about 90°. The grooves 104 in the coating head 100 can be formed in any suitably manner such as by milling, with the grooves being formed to have parallel side walls and a base with the space in between the side walls being substantially uniform along the full course of the grooves.

Figure 9:
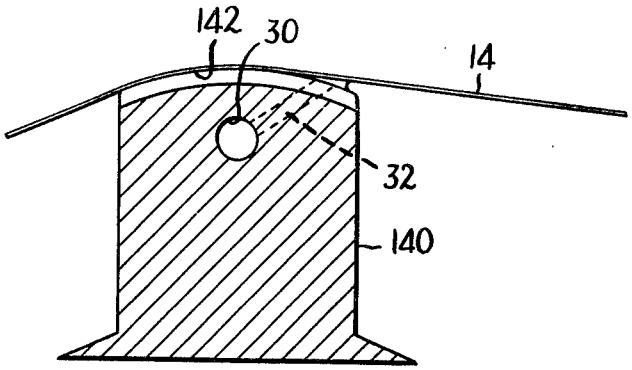
FIG. 9 is a vertical sectional view of a further form of coating head in which a convex or curved contact surface for the strip material is provided at only a portion of the outer periphery of the coating head, the coating head being an oblong generally rectangular shaped component.

FIG. 9 shows a further form of device 140 in which the coating head has a generally oblong shape having only a curved surface 142 at one side thereof which surface provides the strip contacting surface and which is provided with one or more grooves in the same manner described above. Thus, as will be noted in FIG. 9 only a limited extent of the outer periphery of the coating head need be curved with the remainder providing such structure as is required to mount and support the coating head in fixed position.

In operation, the continuous strip can pass over the head in a direction parallel to the grooves, under slight tension to press the surface of one side of the web firmly against the head. This may be insured by causing the strip to leave the head at an angle only slightly different from its angle of approach as shown in FIG. 8. This angle, however, need not be different from 180° and tangential contact (see FIG. 4) will suffice.

It has been observed that with a uniform paper as the moving strip, the placement of the passage openings within the area of strip contact with the lands may lead to undesirable discontinuous or stop-skip application of the coating material. When the paper contains discontinuous areas of perforations which it is particularly intended to coat, this behavior may be used to advantage. With the openings within the area of contact, the liquid will flow readily at the perforated areas, and will be throttled where there are no perforations.

For use in coating thin paper, such as cigaret paper, travel speeds of 1 to 150 feet per minute can be attained. The coating head can be made from various metals such as stainless steel, aluminum, bronze, brass, copper and the like. On the lands where contact with the web is made, the head should be finished to a smoothness of 20 microinches or less. Plastic heads or plastic-covered heads, as for example surfaces of polyethylene, polytetrafluoroethylene, nylon, or polyacetal also can be used. The specific material of choice may be dictated in part by the coating material and solvent system, as will be understood by those skilled in the art.

The description so far has presumed that the underside of the strip will be coated. It is also possible to invert the head and accessories so that the strip passes beneath the head and is coated on top. Approximately vertical travel of the paper at the point coating is also possible. There is in fact a slight advantage to the inverted arrangement. Under certain conditions, the arrangement of FIG. 4 allows deposition of coating material or foreign particles on the head thus requiring subsequent cleaning of the head. In an inverted arrangement such deposits fall to the strip to be carried away as minor flaws. It will be understood that the present invention contemplates use of two heads to coat simultaneously or sequentially both sides of a moving strip. Such dual coatings have greatly enhanced adhesion to those porous strips which adhere poorly to the same coating applied to only one surface.

It will be obvious that if a coating material is to be applied as a hot melt, the coating head should be provided with appropriate heaters.

Figure 5:
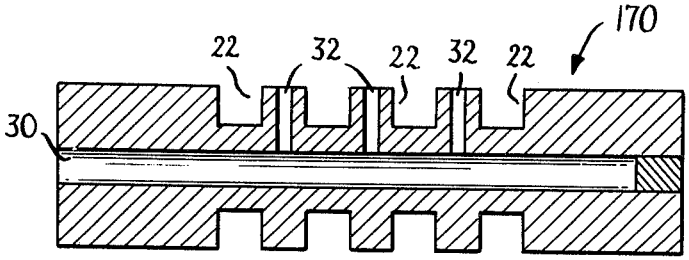
FIG. 5 is a vertical sectional view of a further form of coating head in which each land thereon is provided with a radial branch supply passage for delivering coating material to the surface of the lands.

FIG. 5 depicts another form of coating head 170 in which each land 24 has associated therewith a radial branch passage 32.

It will be apparent from a reading of the foregoing that the method and apparatus for applying a coating to a moving strip as provided in the present invention has been disclosed in certain embodiments thereof only and it is possible to produce still other embodiments without departing from the scope of the inventive concept herein disclosed, and accordingly, it should be understood that all matter contained in the above description and the accompanying drawings should be interpreted as illustrative and not in a limiting sense.

What is claimed is:

1. A method for applying continuous longitudinally extending bands of a liquid coating to a moving strip which comprises providing an elongated coating element having a convex outer surface, there being lands formed in said convex surface in a number corresponding at least to the number of coating bands to be applied, said lands having a width such as to yield the desired band coating width, said lands extending in encircling courses about the long axis of said coating element, each land being defined by a pair of grooves extending inwardly of said convex surface all of said grooves being disposed parallel with each other and transversely of said long axis, said coating element further having a central axial passage therein and radial passages connecting, with the central passage and outletting at an opening in the convex surface of each of said lands, the number of said openings corresponding to the number of bands to be applied at the convex surfaces of said lands, and fixedly disposing said element with its long axis extending transversely of the direction of the travel of the strip whereby the convex surfaces of said lands extend in the direction of strip travel advancing the moving strip in a lead in-lead off contacting engagement with the convex surfaces of said lands, fixing the positioning of said coating element in an orientation relative to the moving strip such as to provide that the openings at the convex surfaces of said lands are located adjacent to but downstream of the point of lead-off contact of the moving strip with the convex surfaces of said lands, and feeding the coating material through said central passage and radial passages for outflow delivery of same at the openings at the convex surfaces of said lands, whereby there is established with the liquid outflowing from each of said openings a meniscus of liquid coating which contacts the said convex surface of each of said lands and said strip downstream of said point of lead-off contact, said meniscus being broken off sharply at the groove surfaces adjacent each of said lands, thereby causing said bands to be applied to said strip.

2. The method according to claim 1 in which the contacting engagement of said moving strip with the convex surfaces of said lands is in a tangential contact course only.

* * * * *